US010480872B2

(12) United States Patent
Ring, Jr. et al.

(10) Patent No.: US 10,480,872 B2
(45) Date of Patent: Nov. 19, 2019

(54) TURBULATORS IN ENHANCED TUBES

(71) Applicant: TRANE INTERNATIONAL INC., Piscataway, NJ (US)

(72) Inventors: H. Kenneth Ring, Jr., Houston, MN (US); Jon P. Hartfield, La Crosse, WI (US); Todd A. Michael, West Salem, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 494 days.

(21) Appl. No.: 14/852,893

(22) Filed: Sep. 14, 2015

(65) Prior Publication Data

US 2016/0076828 A1 Mar. 17, 2016

Related U.S. Application Data

(60) Provisional application No. 62/049,981, filed on Sep. 12, 2014.

(51) Int. Cl.

| | |
|---|---|
| ***F28F 13/12*** | (2006.01) |
| ***F28F 1/42*** | (2006.01) |
| ***F28F 13/18*** | (2006.01) |

(52) U.S. Cl.

CPC ..... *F28F 13/12* (2013.01); *F28F 1/422* (2013.01); *F28F 13/187* (2013.01); *F28F 2001/428* (2013.01)

(58) Field of Classification Search

CPC .... F28F 1/40; F28F 1/405; F28F 13/12; F28F 13/187; F28F 1/44; F28F 1/422

USPC ..... 165/109.1, 179, 184

See application file for complete search history.

(56) References Cited

U.S. PATENT DOCUMENTS

| | | | | |
|---|---|---|---|---|
| 4,641,705 A * | 2/1987 | Gorman | F28F 13/125 165/109.1 |
| 4,798,241 A * | 1/1989 | Jarrett | B01F 5/0614 138/38 |
| 4,858,681 A * | 8/1989 | Sulzberger | F17D 5/04 165/70 |
| 5,497,824 A * | 3/1996 | Rouf | F28F 13/12 138/38 |

(Continued)

FOREIGN PATENT DOCUMENTS

| | | |
|---|---|---|
| CN | 101498561 A | 8/2009 |
| CN | 1022587346 A | 11/2011 |

(Continued)

OTHER PUBLICATIONS

International Search Report and Written Opinion, dated Nov. 26, 2015; PCT/US2015/049730 (17 pages).

(Continued)

*Primary Examiner* — Tho V Duong

(74) *Attorney, Agent, or Firm* — Hamre, Schumann, Mueller & Larson, P.C.

(57) ABSTRACT

A heat exchange tube combines an external surface feature, for example having crushed fins and cavities, which can have very high boiling enhancement characteristics, with an internal surface feature, for example having high performing intersecting helices, e.g. "cross hatched" with an intersecting helix angle. The new tube can provide a high performing tube in a shell and tube evaporator that can be relatively smaller, more efficient, and that can use relatively lower refrigerant charge.

15 Claims, 15 Drawing Sheets

(56) References Cited

U.S. PATENT DOCUMENTS

| | | | | |
|---|---|---|---|---|
| 5,697,430 | A | 12/1997 | Thors et al. | |
| 6,018,963 | A * | 2/2000 | Itoh | F25B 39/00 165/133 |
| 6,119,769 | A * | 9/2000 | Yu | F28D 1/0475 138/38 |
| 7,178,361 | B2 | 2/2007 | Thors et al. | |
| 7,254,964 | B2 | 8/2007 | Thors et al. | |
| 7,451,542 | B2 * | 11/2008 | Brand | B21C 37/207 29/890.03 |
| 2005/0230094 | A1 | 10/2005 | Komatsubara | |
| 2006/0075772 | A1 | 4/2006 | Thors et al. | |
| 2007/0151713 | A1 * | 7/2007 | Lee | F28D 1/0477 165/109.1 |
| 2009/0183857 | A1 | 7/2009 | Pierce et al. | |
| 2011/0247793 | A1 * | 10/2011 | Schoubye | F28F 1/40 165/177 |
| 2012/0292000 | A1 | 11/2012 | Khan et al. | |

FOREIGN PATENT DOCUMENTS

| | | | |
|---|---|---|---|
| JP | 08-170891 | 7/1996 | |
| JP | 11108578 A * | 4/1999 | F28D 7/16 |
| NL | 1025380 C1 | 8/2005 | |

OTHER PUBLICATIONS

Extended European Search Report; European Patent Application No. 15840817.9, dated Apr. 19, 2018 (7 pages).

* cited by examiner

DETAIL D

VIEW B-B

TURBULATORS IN ENHANCED TUBES

FIELD

The disclosure herein relates to a heat exchanger, such as for example a shell and tube heat exchanger which may be used for example in a heating, ventilation, and air conditioning system (HVAC) system and/or unit thereof, such as may include a fluid chiller. The heat exchanger includes tubes with outer and inner surface features to enhance fluid heat exchange on and through the tubes. A combination of a tube with inner surface features and a turbulator is also disclosed.

BACKGROUND

Heat exchangers that may be used for example in HVAC systems can include various round tube designs, such as for example shell and tube heat exchangers. The round tubes have surface features on the outside of the tube or on the inside of the tube, of which are intended to enhance heat transfer on or through the tubes.

SUMMARY

A heat exchanger is described that includes heat exchange tubes with one or more external surface features and with one or more internal surface features, both of which are to enhance heat exchange of fluid on the tube side and on the side outside of the tube. A combination of a tube with inner surface features and a turbulator is also disclosed.

I. Enhanced Tubes

In some embodiments, the external surface feature(s) can include a fin structure that has been crushed. The fin structure has fins with notches. The notches can have a depth and the fins can have a height from a root, where cavities can be defined between fins. A top of the fin can have one or more of the notches, and the fin can be crushed or otherwise bent to create from the notches one or more side cavities on the fin. The fin structure can have a certain number of fins or fin frequency (e.g. fins per length of tube), certain fin height(s), the one or more cavities on the fins and/or the cavities between fins can be designed with various configurations and/or dimensions to achieve, for example a certain cavity nucleation and a certain flow into and out of cavities present on the tube.

In some embodiments, the internal surface feature(s) can include a rib structure where, in certain circumstances, the rib structure may be rifled into a helical configuration. In some embodiments, there may be more than one rifle through the tube, where the rifles can have various configurations. For example, the rifles may be arranged in a cross hatched configuration from two or more helixes (or helices) that cross over each other. The rib structure can have a rib height, depth between the ribs, and rib frequency (e.g. ribs per length of tube). In the example of using a helical rib configuration, a certain helix angle may be used. Generally, the rib structure overall can be designed with various configurations and/or dimensions to achieve a certain pressure drop limit.

In some embodiments, both the inner surfaces feature(s) and outer surface feature(s) can be designed to obtain a certain performance target which can be described for example with respect to a heat transfer coefficient, e.g. Btu/hr-ft$^2$-F, which is an expression of heat transfer rate (e.g. Btu/hr) and heat transfer area (e.g. ft$^2$), also known as heat flux, and temperature (e.g. degree F.). It will be appreciated that in the heat transfer coefficient, a water flow and Reynolds number may be considered as to the tube side performance (e.g. inside of the tube), where heat flux may be considered as to the shell side performance (e.g. outside of the tube), and where temperature may be considered as to both. By specifying these parameters an adequate performance goal may be set to have a meaningful comparison of performance.

In one embodiment, performance gains in terms of overall heat transfer coefficient in a tube bundle in an evaporator can be as high as about 15% to about 30% relative to other heat transfer tubes that, for example, only employ one of the surfaces alone.

In one embodiment, the performance gains can be realized by a combination of certain parameters or conditions, which include for example but may not be limited to, heat flux, temperature, and water flow. Such defined parameters may be used to determine the construction of the inner and outer surface feature(s), to obtain the performance gains as noted above and would not have been necessarily expected when simply combining the outer and inner surfaces, or when looking at data available on the tubes that employ one of the outer or inner surface features alone. In some embodiments, the heat flux parameter can be e.g. at or about 5000 Btu/hr-ft$^2$ to at or about 20000 Btu/hr-ft$^2$, and e.g. at or about 13000 Btu/hr-ft$^2$, the temperature can be, e.g. at or about 38° F. to at or about 45° F., and e.g. at or about 42° F., and the water flow rate can be described in terms of a Reynolds number and can be e.g. at or about 12000 to at or about 42500, and range at flow rates of at or about 3 to at or about 12 gallons per meter, and e.g. at or about 6.8 gallons per meter to at or about 8.22 gallons per meter. A pressure drop limit can be at or about 49° F.

In some embodiments, the heat exchanger in which the heat exchange tubes are used, is a shell and tube heat exchanger, used for example in an evaporator or other boiling tube application. The shell and tube heat exchanger and its tubes may be employed in an HVAC system and/or one or more units thereof. It will be appreciated that the heat exchange tubes herein may be suitably employed in any shell and tube evaporator that employs boiling tubes, including for example falling film and/or flooded film evaporators. In some embodiments, the HVAC system or unit includes a fluid chiller, such as for example a water chiller, in which the heat exchanger with tubes as described herein, can be incorporated. It will also be appreciated that the heat exchanger tubes is not meant to be limited to water chillers, as the heat exchange tubes may be used applicable to any system or unit that has a need for boiling tubes. It will be appreciated that the fluid in the tube side may be water or glycol or other similar fluid, and the fluid on outside the tube, e.g. the shell side may be a refrigerant.

In one embodiment, the unit in which the heat exchange tubes are applied is an evaporator of a 50 and/or 60 Hz air cooled water chiller that employs R134a type refrigerant and that has about 140 ton to about 500 ton cooling capacity.

In some embodiments, the type of refrigerant employed in a shell and tube heat exchanger may impact the tube construction including for example the outer surface feature(s). For example, any type of refrigerant may be employed and be suitable for use with the heat exchange tubes herein, including but not limited to for example HCFC, HFC, and/or HFO refrigerants and blends thereof, may have varying specific volumes and varying pressure ratings. For example, R123 which is a relatively low pressure refrigerant with a relatively lower specific volume may use relatively larger cavity designs to achieve suitable fluid flow. For example, R134a which is a relatively medium pressure refrigerant with a relatively medium specific volume may use relatively smaller cavity designs to achieve suitable fluid flow. For example, R410 which is a relatively high pressure refrigerant with a relatively higher specific volume may use relatively smaller cavity designs to achieve suitable fluid flow.

In one embodiment, the material of the tube is made of copper, such as for example a copper alloy.

In one embodiment, it will be appreciated that the tube can withstand pressures of at or about 200 psig and higher.

In one embodiment, the outer diameter of the tube is at or about 0.75 inches or at or about 1.0 inches.

In one embodiment, the inner diameter may be dependent upon a nominal wall thickness of the tube, which in some embodiments may be at or about 0.22 inches to at or about 0.28 inches, and where in some embodiments, the nominal wall thickness is at or about 0.25 inches. It will be appreciated that the inner diameter may be determined from the outer tube diameter and the selected nominal wall thickness.

II. Turbulators in Enhanced Tubes

A heat exchange tube including external surface features and/or one or more internal surface features to enhance heat exchange of fluid on the tube side and on the side outside of the tube are sometimes called an enhanced tube. In some embodiments, a turbulator may be installed on the tube side of the enhanced tube. The turbulator is generally a device configured to generate turbulence in a fluid flow. The combination of the turbulator and the enhanced tube can improve heat exchange efficiency when the fluid flow has a relatively low Reynolds number (e.g. equal to or about 8,000 or less than 8,000), which in some circumstances may be suitable for a low temperature application.

A heat exchange tube includes: inner surface features; and a turbulator extends in a longitudinal direction inside the heat exchange tube.

In some embodiments, at least a portion of the turbulator is positioned on the inner surface features.

In some embodiments, the heat exchange tube also includes outer surface features, e.g. any of the enhanced tubes described herein.

In some embodiments, the inner surface features contribute significantly to heat transfer coefficient when a working fluid flow is in a turbulent regime.

In some embodiments, the turbulator contributes significantly to heat transfer coefficient when a working fluid flow is in a transition regime.

In some embodiments, the turbulator and the inner surface features contribute significantly to heat transfer coefficient when a working fluid flow is in an intermediate regime, an intermediate regime including Reynolds numbers lower than a transition Reynolds number between a transition regime and a turbulent regime, and Reynolds numbers higher than the transition Reynolds number.

In some embodiments, the turbulator can be made of metal, such as for example copper. In some embodiments, the turbulator can be made of a non-metal material. In some embodiments, the material of the turbulator may be non-corrosive and compatible with the material (e.g. copper) of the heat exchange tubes, compatible with the working fluid (e.g. water and/or glycol) and/or non-dissolvable in the working fluid.

A method of fluid flow through a heat exchanger includes: directing a working fluid through the heat exchange tubes with the inner surface features and the turbulator. In some embodiments, directing the working fluid includes directing through a single pass of a heat exchanger, such as a shell and tube heat exchanger.

A method of making a heat exchange tube, includes: providing inner surface features configured to significantly generate turbulence in a turbulent fluid flow regime on an inner surface of the heat exchange tube; providing a turbulator where the turbulator is configured to significantly generate turbulence in a transition fluid flow regime; and installing the turbulator in the heat exchange tube.

In some embodiments, the inner surface features and the turbulator are configured to contribute synergistically in an intermediate regime including Reynolds numbers lower than a transition Reynolds number between a transition regime and a turbulent regime, and Reynolds numbers higher than the transition Reynolds number.

In some embodiments, the method of making the heat exchange tube may include: fixing a first end of the turbulator on a first end of the heat exchange tube; and extending a second end of the turbulator to a second end of the heat exchange tube.

In some embodiments, the turbulator may have a diameter that is larger than an inner diameter of the heat exchange tube. When the turbulator is extended in the heat exchange tube, a retraction tendency of the turbulator pushes the turbulator against the inner surface of the heat exchange tube to retain the turbulator within the heat exchange tube Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

I. Enhanced Tubes

Enhanced copper tubing is used to transfer heat from a single phase fluid stream (typically water or glycol) to a refrigerant in a shell and tube evaporator. Heat transfer efficiency is improved by using enhanced surfaces on the inside and outside of the heat transfer tube. Inside surface enhancements typically increase flow turbulence and increase heat transfer surface area, while external evaporator tube enhancements aim to create nucleation cavities to stimulate boiling. Typically, internal enhancements are "rifled" ridged surfaces and external enhancements are notched and crushed fins of some type.

Generally, a heat exchange tube herein combines external surface feature(s), for example crushed fins and cavities, which can have very high boiling enhancement characteristics, with internal surface feature(s), for example having high performing intersecting helices, e.g. "cross hatched" with an intersecting helix angle. The heat exchange tube herein can provide a high performing tube in an evaporator that can be relatively smaller, more efficient, and that can use relatively lower refrigerant charge.

Figure 1:
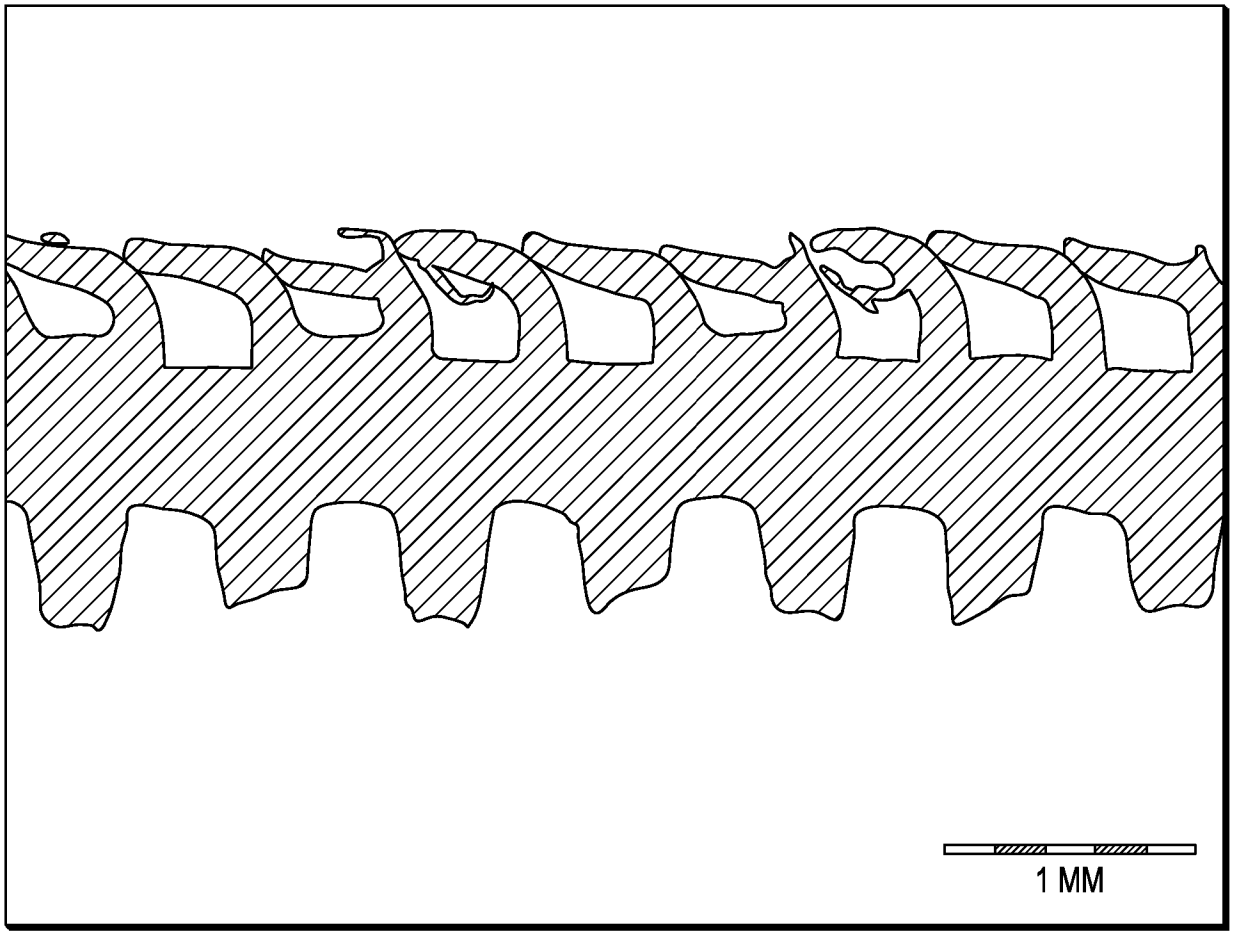
FIG. 1 is a side sectional picture of an embodiment of a heat exchange tube.

See for example FIG. 1 which shows on the outer (upper) surface such features as above on some of the fins and on the inner (lower) surface are the ribs. The helical, cross hatch is not visible in this view, but see e.g. embodiment of FIG. 8D, which is further described below. In one embodiment, a heat exchange tube herein can have outer surface features that obtain high external refrigerant boiling performance, and which can have for example, characteristics of dual cavity nucleate boiling pores created by notched fins which are bent or flattened. As one example only, U.S. Pat. Nos. 7,178,361 and 7,254,964, which are incorporated herein by reference in their entirety, describe the construction of such surface features and how they may be made.

Figure 2:
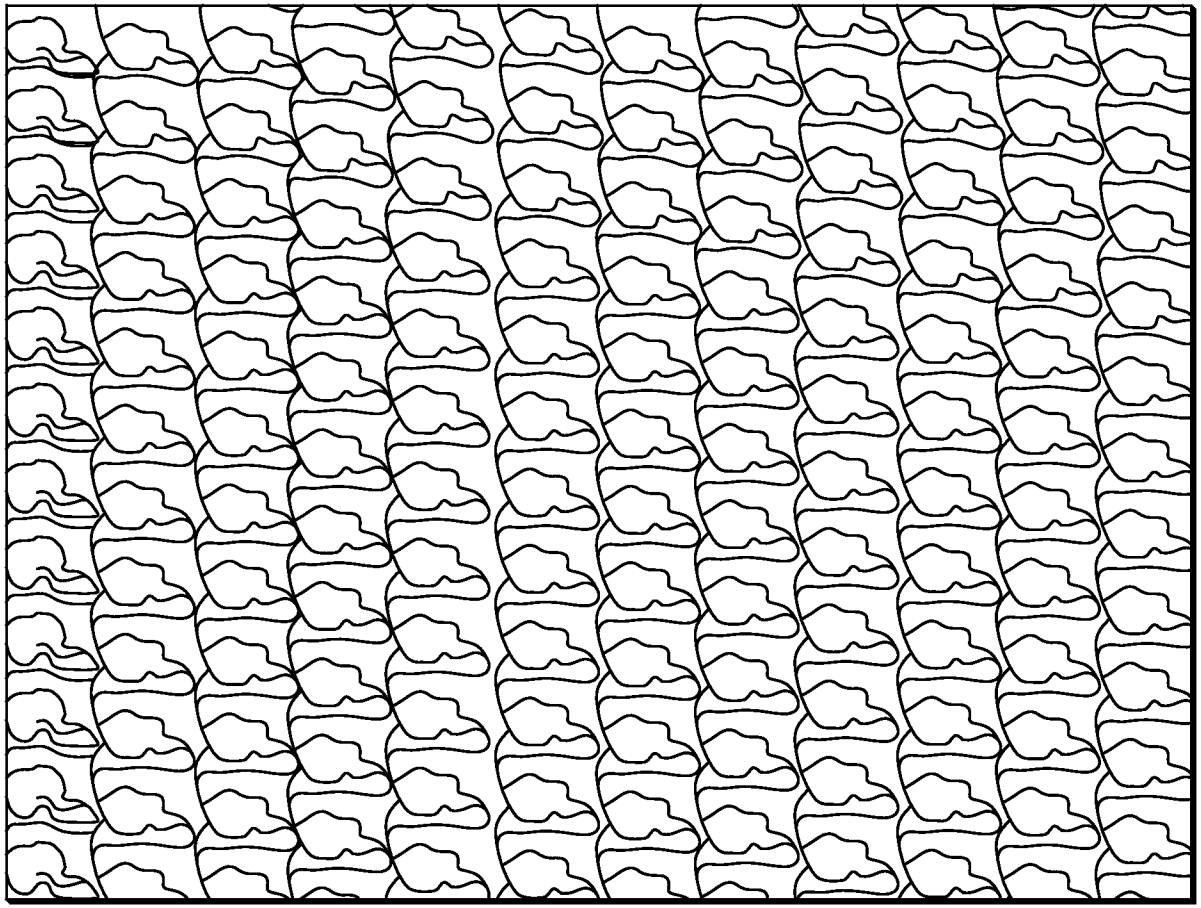
FIGS. 2 to 4 are pictures of the outer surface features that may be incorporated on the heat exchange tube of FIG. 1.
Figure 3:
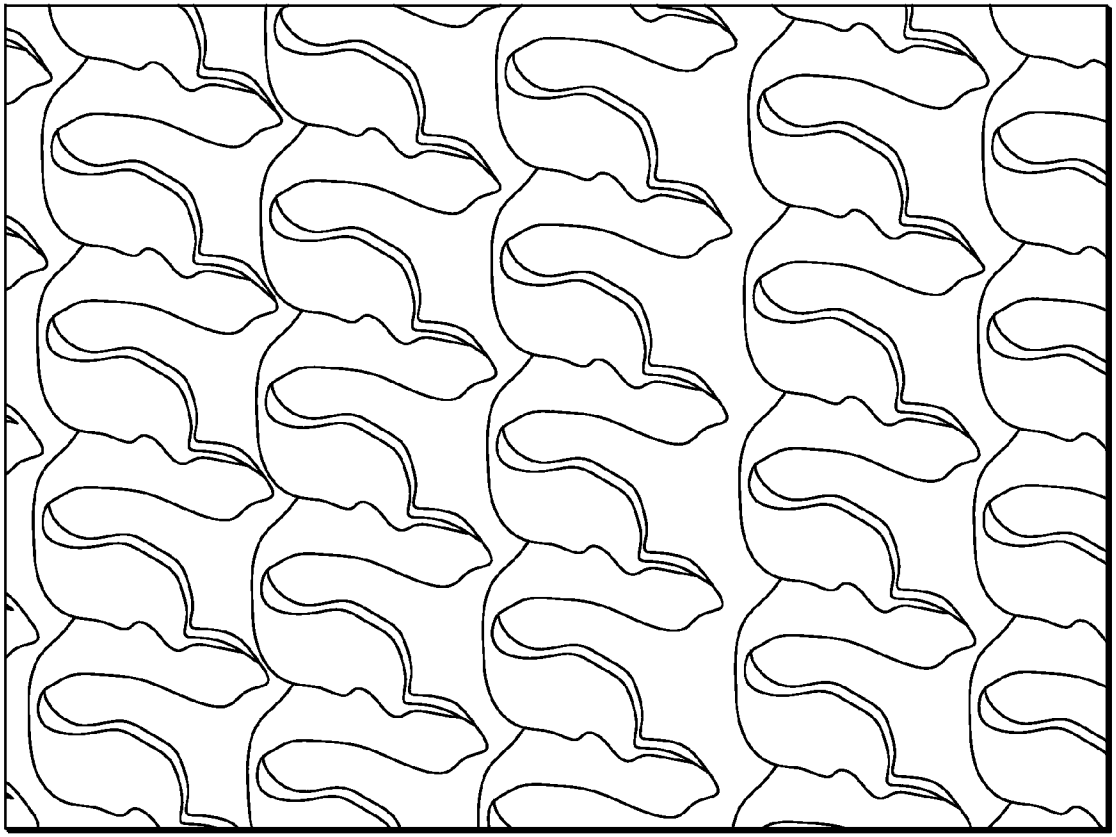
Figure 4:
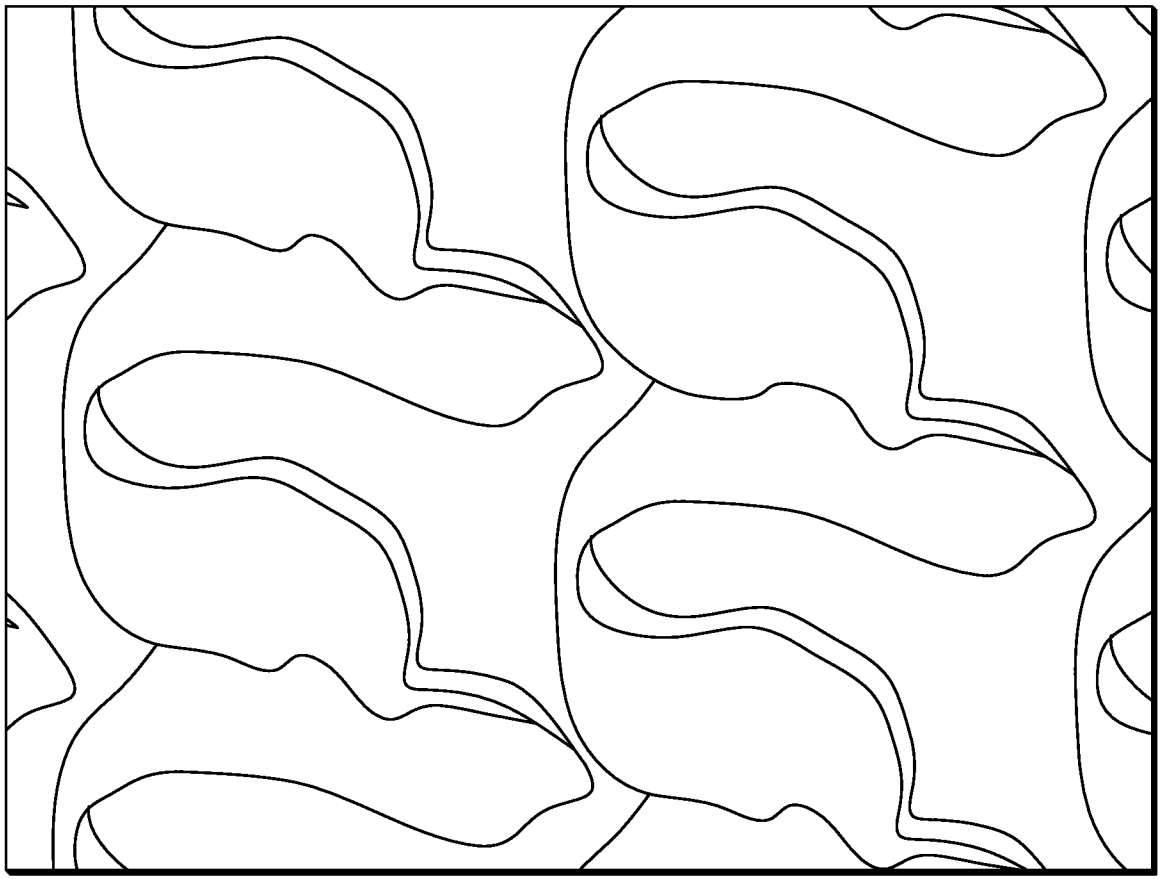

See for example FIGS. 2 to 4 which show straight on views of the outer surface features and that are progressively closer views of the outer surface.

In one embodiment, a heat exchange tube herein can have inner surface feature(s) that are capable of creating high single phase flow heat transfer coefficients. For example, such surface(s) include a rifle pattern, such as for example two rifle patterns, which may have different or the same sizes and/or helix angles, that are arranged in an intersecting helix "cross-hatched" surface. As one example only, U.S. Pat. No. 7,451,542, which is incorporated by reference in its entirety, describes the construction of such surface features and how they may be made.

Figure 5:
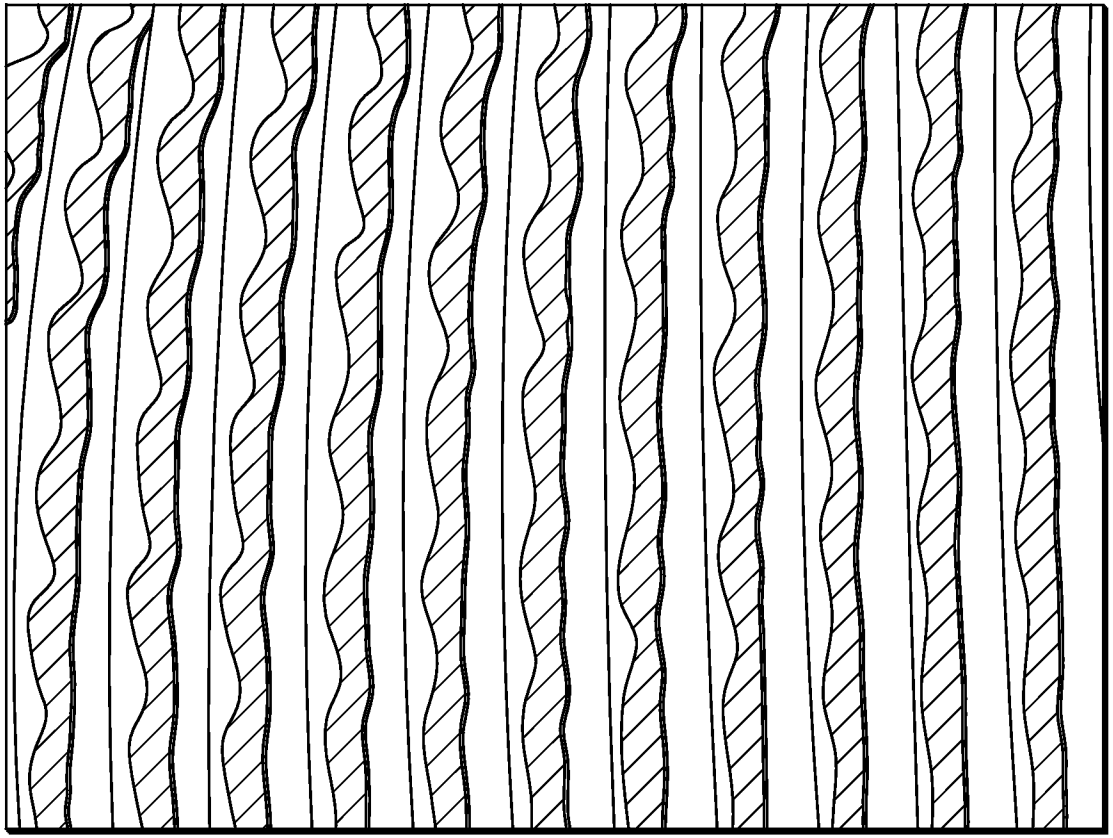
FIGS. 5 to 7 are pictures of the inner surface features that may be incorporated on the heat exchange tube of FIG. 1.
Figure 6:
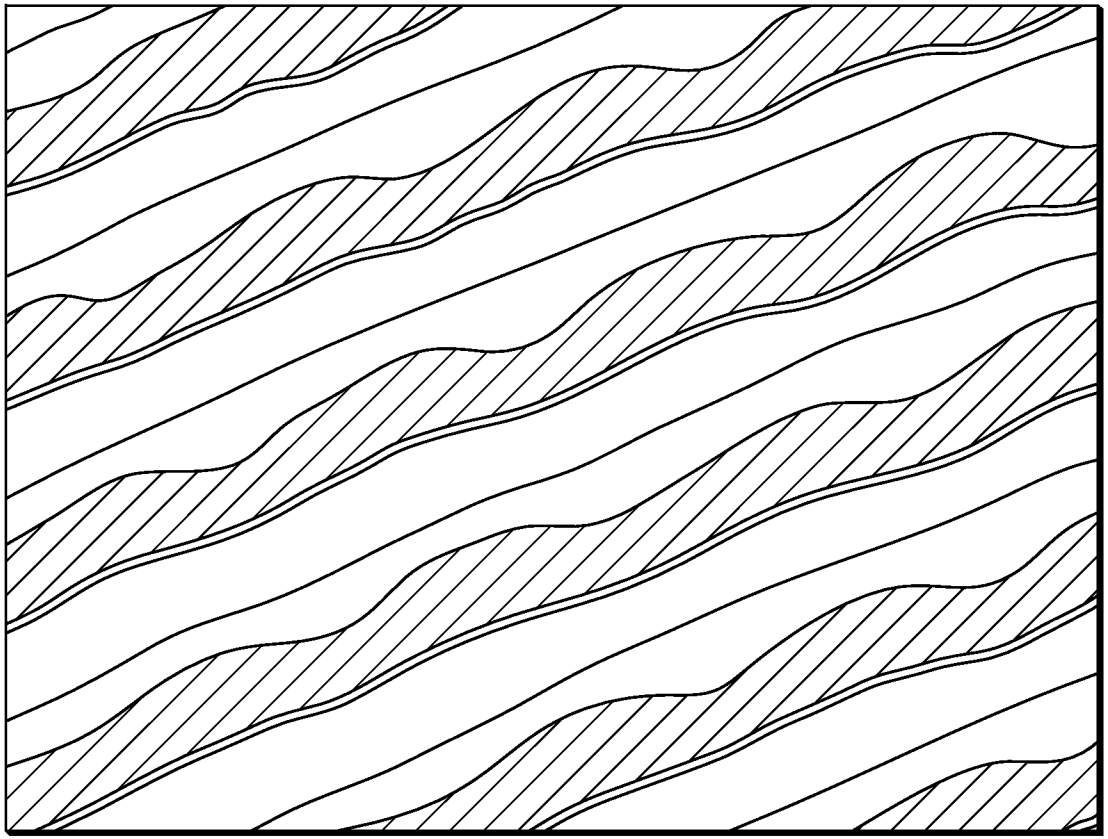
Figure 7:
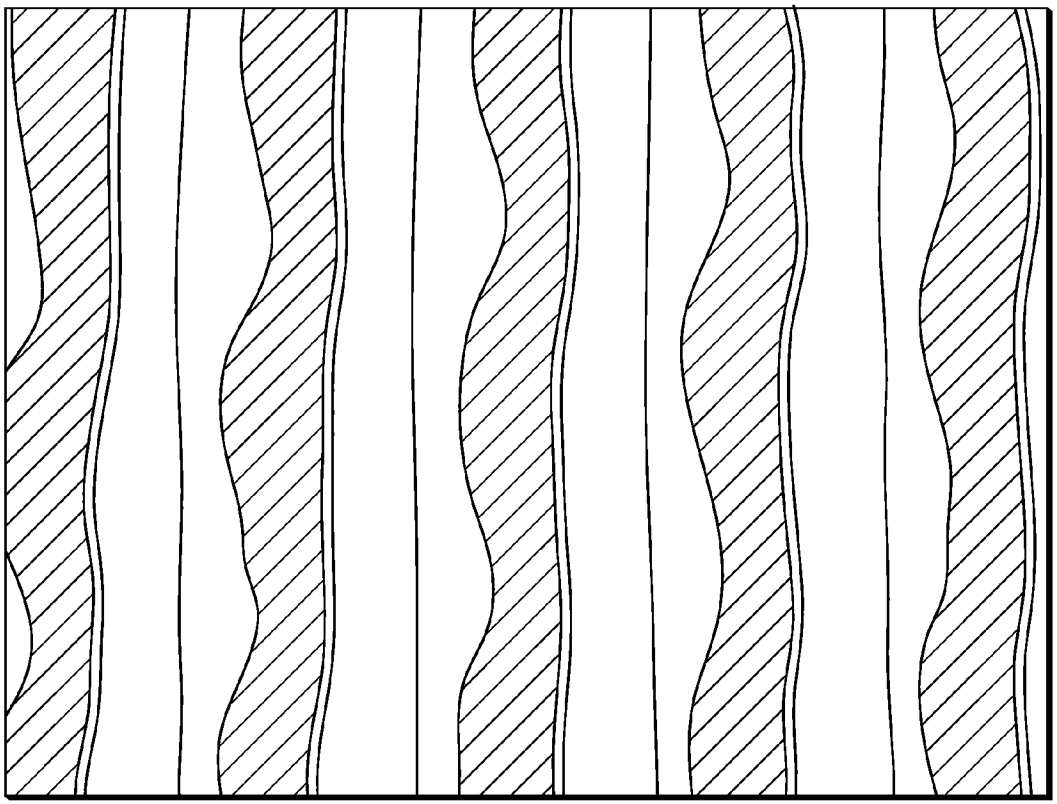

See for example FIGS. 5 to 7 which show straight on views of the inner surface features and that are progressively closer views of the inner surface.

Figure 8A:
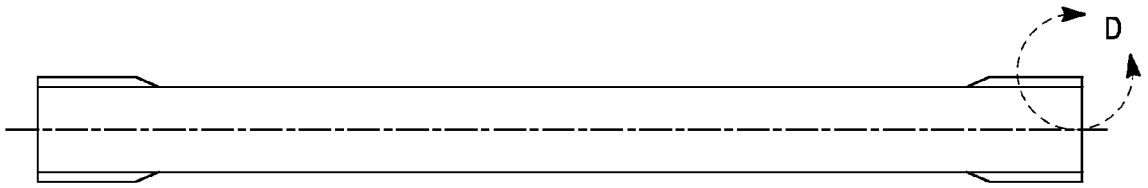
FIGS. 8A to 8F are various side, side sectional, partials thereof, and end views of an embodiment of a heat exchange tube.
Figure 8B:
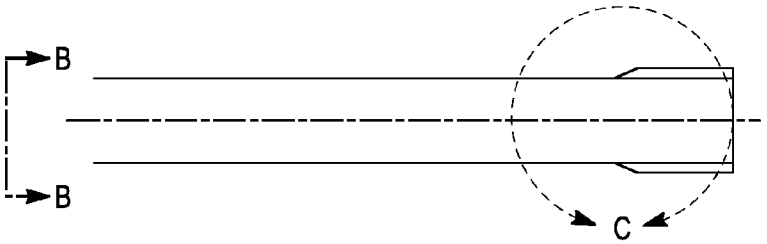
Figure 8C:
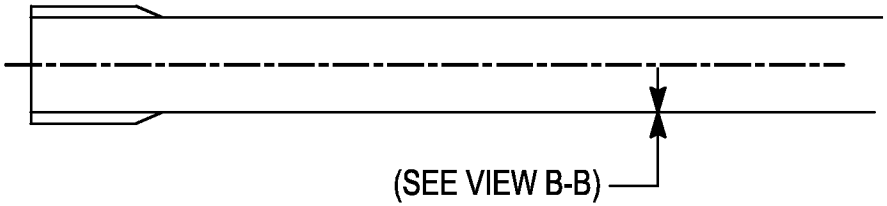
Figure 8D:
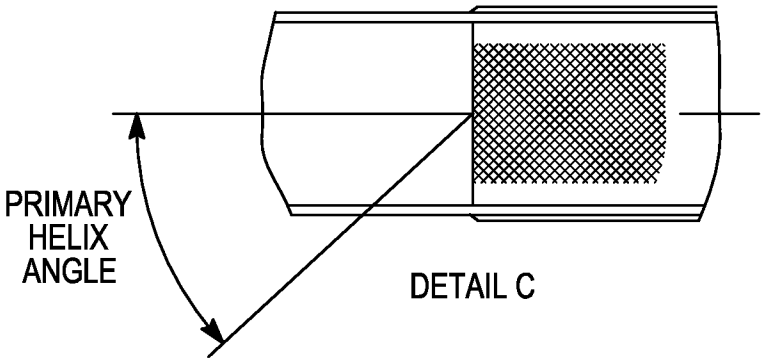
Figure 8E:
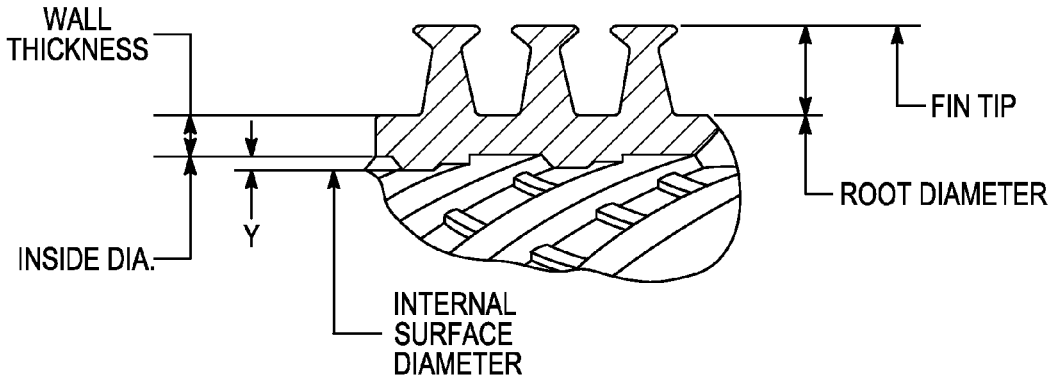
Figure 8F:
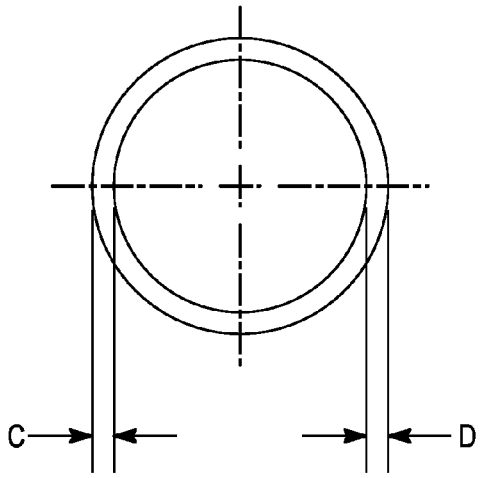

FIGS. 8A to 8F show various side, side sectional, partials thereof, and end views of another embodiment of a heat exchange tube that is 0.75 inches in outer diameter. FIGS. 8A to 8C are side views and partial side views, of which FIGS. 8D to 8F show respective details of FIGS. 8A to 8C. FIG. 8D shows the cross hatching rib and grooves with helix angles. Where the internal surface features have two helices creating ribs that are cross hatched. The helix angle in an embodiment can be at or about 50°±2°. FIG. 8E shows both the external and outer surface features, where the external fins per inch may be about forty-eight nominal. The height of the rib on the inner surface, e.g. at Y from the inside diameter to the internal surface diameter, may be at or about 0.47±0.05 mm and also shows the cross hatching. FIG. 8E also shows a wall thickness from the outside surface, e.g. at the root diameter, to an inside diameter. FIG. 8E also shows a fin tip dimension from the outer surface, e.g. at the root diameter, to the end of the fin. FIG. 8F shows the wall thickness for example at C and D, which can be at or about 0.635 mm (e.g. 0.25 inches).

Figure 9:
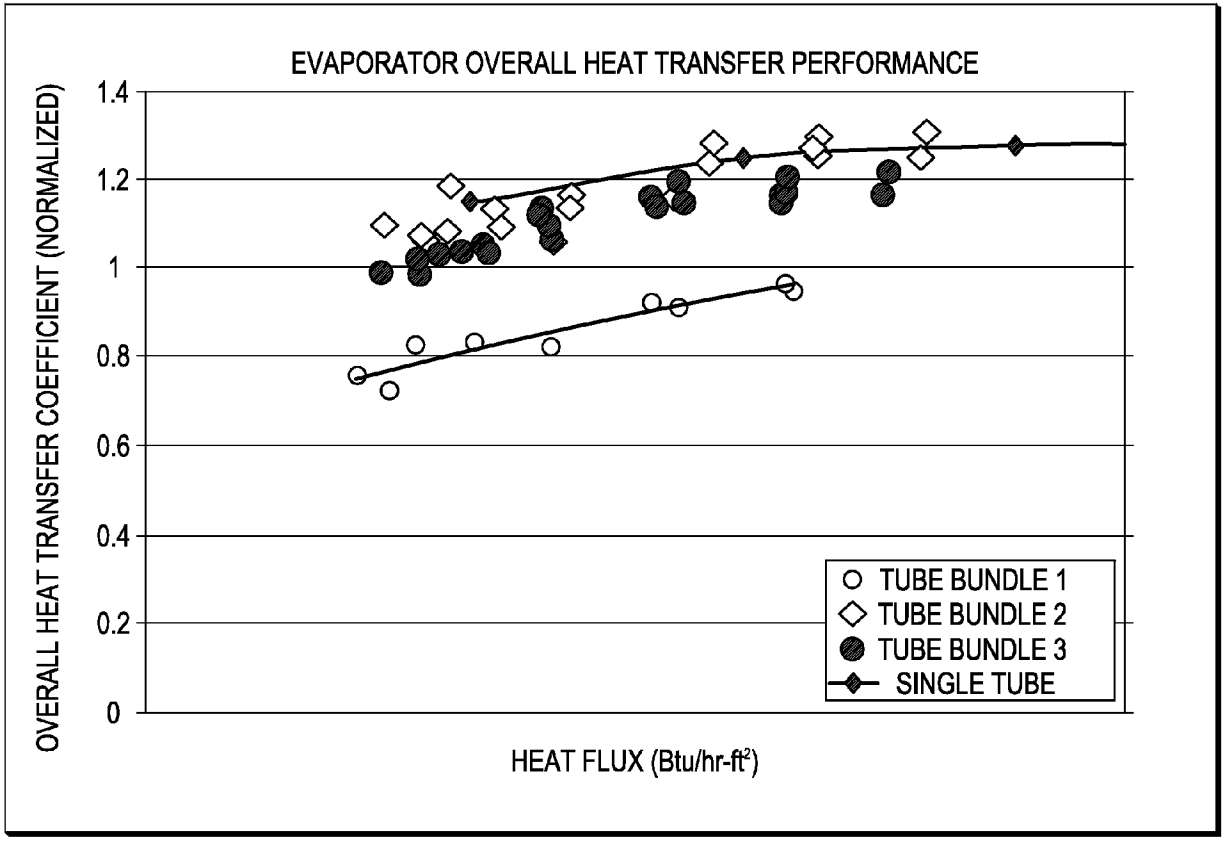
FIG. 9 is a performance comparison data on various heat transfer tubes.
Figure 10:
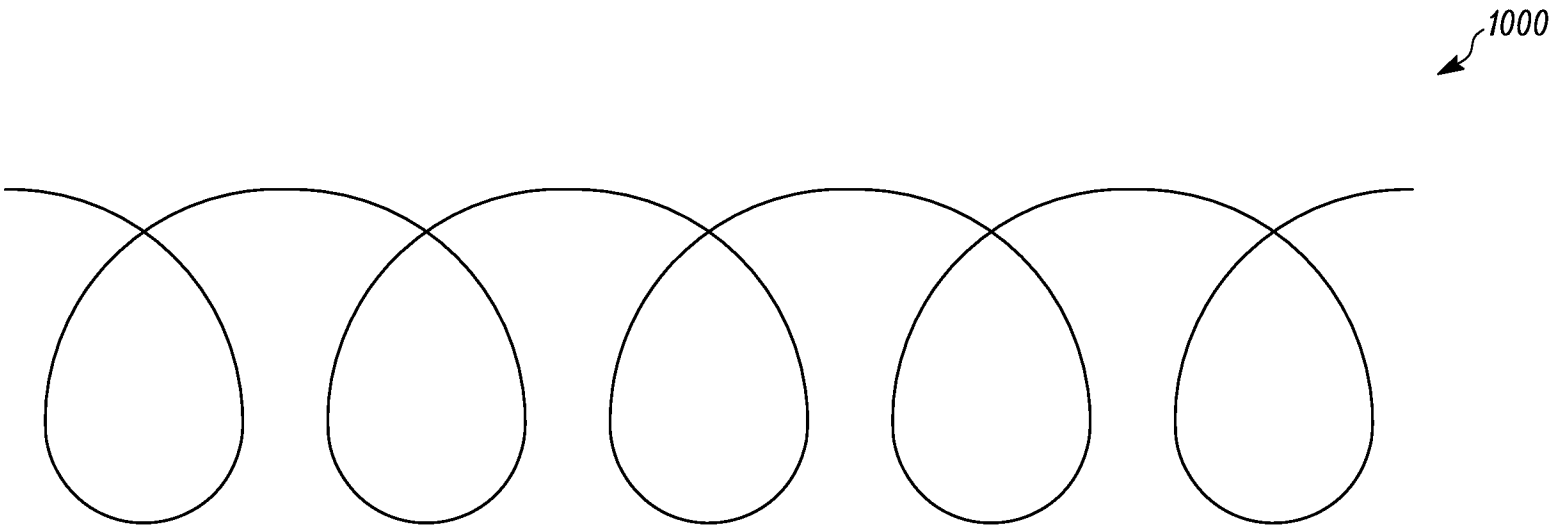
FIG. 10 is a turbulator according to an embodiment.

FIG. 9 is a performance comparison data on various heat transfer tubes. As described above, in one embodiment, performance gains in terms of overall heat transfer coefficient in a tube bundle using the heat exchange tubes described herein can be as high as about 15% to about 30% relative to other heat transfer tubes that, for example, only employ one of the surfaces alone. FIG. 9 shows three tube bundle examples including tube bundle 1, tube bundle 2, and tube bundle 3. Tube bundle 1 is a previous design using only outer surface features to enhance heat exchange. Tube bundles 2 and 3 incorporate both the external and internal surfaces feature(s) described herein. Tube bundles 2 and 3 show at least about 20% improved performance over tube bundle 1 and as high as about 30% improvement. Further, it is shown that tube bundles 2 and 3 approach equivalent performance compared to a single tube evaluated under similar conditions, see e.g. Single Tube line. It can be appreciated that in some circumstances a tube bundle may be de-rated relative to the evaluation and performance of a single tube since there may be some losses when evaluating performance of a tube bundle. However, as shown in FIG. 9, tube bundles 2 and 3 show data that the bundles perform at or approaching that of a single tube depending on the heat flux. It will be appreciated that similar results were observed when observing tube bundles which only employed surface features on the inner surface of the tube.

It will be appreciated that in the past, the manufacturing methods to produce a tube with one of the surface features alone, i.e. on the outer alone or on the inner alone, may have some difficulties and challenges as to being directly applicable to manufacturing methods to combine both the outer surface feature(s) with the inner surface feature(s) onto one tube.

Aspects

It will be appreciated that any of the aspects below may be combined with any other of the aspects below.

Aspect. A heat exchanger is described that includes heat exchange tubes with one or more external surface features and with one or more internal surface features, both of which are to enhance heat exchange of fluid on the tube side and on the side outside of the tube.

Aspect. In some embodiments, the external surface feature(s) can include a fin structure that has been crushed.

Aspect. The fin structure has fins with notches.

Aspect. The notches can have a depth and the fins can have a height from a root, where cavities can be defined between fins.

Aspect. A top of the fin can have one or more of the notches, and the fin can be crushed or otherwise bent to create from the notches one or more side cavities on the fin.

Aspect. The fin structure can have a certain number of fins or fin frequency (e.g. fins per length of tube), certain fin height(s), the one or more cavities on the fins and/or the cavities between fins can be designed with various configurations and/or dimensions to achieve, for example a certain cavity nucleation and a certain flow into and out of cavities present on the tube.

Aspect. In some embodiments, the internal surface feature(s) can include a rib structure where, in certain circumstances, the rib structure may be rifled into a helical configuration.

Aspect. In some embodiments, there may be more than one rifle through the tube, where the rifles can have various configurations.

Aspect. For example, the rifles may be arranged in a cross hatched configuration from two or more helixes (or helices) that cross over each other.

Aspect. The rib structure can have a rib height, depth between the ribs, and rib frequency (e.g. ribs per length of tube).

Aspect. In the example of using a helical rib configuration, a certain helix angle may be used.

Aspect. Generally, the rib structure overall can be designed with various configurations and/or dimensions to achieve a certain pressure drop limit.

Aspect. In some embodiments, both the inner surfaces feature(s) and outer surface feature(s) can be designed to obtain a certain performance target which can be described for example with respect to a heat transfer coefficient, e.g. Btu/hr-ft$^2$-F, which is an expression of heat transfer rate (e.g. Btu/hr) and heat transfer area (e.g. ft$^2$), also known as heat flux, and temperature (e.g. degree F.).

Aspect. It will be appreciated that in the heat transfer coefficient, a water flow and Reynolds number may be considered as to the tube side performance (e.g. inside of the tube), where heat flux may be considered as to the shell side performance (e.g. outside of the tube), and where temperature may be considered as to both.

Aspect. By specifying these parameters an adequate performance goal may be set to have a meaningful comparison of performance.

Aspect. In one embodiment, performance gains in terms of overall heat transfer coefficient in a tube bundle in an evaporator can be as high as at or about 15% to at or about 30% relative to other heat transfer tubes that, for example, only employ one of the surfaces alone.

Aspect. In one embodiment, the performance gains can be realized by a combination of certain parameters or conditions, which include for example but may not be limited to, heat flux, temperature, and water flow.

Aspect. Such defined parameters may be used to determine the construction of the inner and outer surface feature(s), to obtain the performance gains as noted above and would not have been necessarily expected when simply combining the outer and inner surfaces, or when looking at data available on the tubes that employ one of the outer or inner surface features alone.

Aspect. In some embodiments, the heat flux parameter can be e.g. at or about 5000 Btu/hr-ft$^2$ to at or about 20000 Btu/hr-ft$^2$, and e.g. at or about 13000 Btu/hr-ft$^2$, the temperature can be, e.g. at or about 38° F. to at or about 45° F., and e.g. at or about 42° F., and the water flow rate can be described in terms of a Reynolds number and can be e.g. at or about 12000 to at or about 42500, and range at flow rates of at or about 3 to at or about 12 gallons per meter, and e.g. at or about 6.8 gallons per meter to at or about 8.22 gallons per meter. A pressure drop limit can be at or about 49° F.

Aspect. In some embodiments, the heat exchanger in which the heat exchange tubes are used, is a shell and tube heat exchanger, used for example in an evaporator or other boiling tube application.

Aspect. The shell and tube heat exchanger and its tubes may be employed in an HVAC system and/or one or more units thereof Aspect. It will be appreciated that the heat exchange tubes herein may be suitably employed in any shell and tube evaporator that employs boiling tubes, including for example falling film and/or flooded film evaporators.

Aspect. In some embodiments, the HVAC system or unit includes a fluid chiller, such as for example a water chiller, in which the heat exchanger with tubes as described herein, can be incorporated.

Aspect. It will also be appreciated that the heat exchanger tubes is not meant to be limited to water chillers, as the heat exchange tubes may be used applicable to any system or unit that has a need for boiling tubes.

Aspect. It will be appreciated that the fluid in the tube side may be water or glycol or other similar fluid, and the fluid on outside the tube, e.g. the shell side may be a refrigerant.

Aspect. In one embodiment, the unit in which the heat exchange tubes are applied is an evaporator of a 50 and/or 60 Hz air cooled water chiller that employs R134a type refrigerant and that has about 140 ton to about 500 ton cooling capacity.

Aspect. In some embodiments, the type of refrigerant employed in a shell and tube heat exchanger may impact the tube construction including for example the outer surface feature(s).

Aspect. For example, any type of refrigerant may be employed and be suitable for use with the heat exchange tubes herein, including but not limited to for example HCFC, HFC, and/or HFO refrigerants and blends thereof, may have varying specific volumes and varying pressure ratings.

Aspect. For example, R123 which is a relatively low pressure refrigerant with a relatively lower specific volume may use relatively larger cavity designs to achieve suitable fluid flow.

Aspect. For example, R134a which is a relatively medium pressure refrigerant with a relatively medium specific volume may use relatively smaller cavity designs to achieve suitable fluid flow.

Aspect. For example, R410 which is a relatively high pressure refrigerant with a relatively higher specific volume may use relatively smaller cavity designs to achieve suitable fluid flow.

Aspect. In one embodiment, the material of the tube is made of copper, such as for example a copper alloy.

Aspect. In one embodiment, it will be appreciated that the tube can withstand pressures of at or about 200 psig and higher.

Aspect. In one embodiment, the outer diameter of the tube is at or about 0.75 inches or at or about 1.0 inches.

Aspect. In one embodiment, the inner diameter may be dependent upon a nominal wall thickness of the tube, which in some embodiments may be at or about 0.22 inches to at or about 0.28 inches.

Aspect. In some embodiments, the nominal wall thickness is at or about 0.25 inches.

Aspect. It will be appreciated that the inner diameter may be determined from the outer tube diameter and the selected nominal wall thickness.

II. Turbulators in Enhanced Tubes

The term "enhanced tube" generally refers to a heat exchange tube that includes surface features on an outer surface and/or an inner surface (i.e. a tube side surface). For example, the heat exchange tubes as disclosed herein may have surface features on both of the outer surface and the inner surface, with the understanding that the enhanced tubes may include a heat exchange tube having surface features only on one of the outer surface or the inner surface. The embodiments disclosed herein are generally applied to an inner surface of an enhanced tube with surface features on the inner surface.

An enhanced tube generally performs well in improving heat exchange efficiency when a Reynolds number of a working fluid flow is relatively high (e.g. higher than 8,000). The surface features can create, for example, turbulence in the fluid flow, and/or disrupt a boundary laminate flow layer in the fluid flow, such as proximate the wall of the tube side, which can improve heat exchange efficiency. A working fluid flow with a relatively high Reynolds number may typically have a relatively small viscosity (e.g. water).

However, in certain applications, for example, in a low temperature application (e.g. at or below 32° F.), the working fluid in the heat exchange tubes of a HVAC system may freeze. An anti-freezing agent or freeze inhibitor, such as glycol, may be added to the working fluid to lower the freezing temperature of the working fluid. The anti-freezing agent can be relatively more viscous than the working fluid, and can lower the Reynolds number of the working fluid flow. Experimental data showed that the enhanced tube may not have much heat exchange efficiency benefit over a smooth heat exchange tube when the Reynolds number of the working fluid flow is relatively low (e.g. a little above, equal to, or lower than 8,000, see e.g. FIG. 12).

The disclosure herein is directed to a combination of a turbulator with an enhanced tube, particularly an enhanced tube with surface features on an inner side of the enhanced tube. The turbulator can be installed on an inner surface of the enhanced tube. In some embodiments, a portion of the turbulator is in direct contact with the surface features of the inner side. The turbulator can help improve heat exchange efficiency when, for example, a Reynolds number of a working fluid flow is relatively low. The combination of the turbulator and the enhanced tube can improve heat exchange efficiency for a wider range of Reynolds number compared to the enhanced tube alone. Using the combination of the turbulator and the enhanced tube in a HVAC system may expand an operation range and/or efficiency of the HVAC system, and may be suitable for a low temperature operation and/or a working fluid with low flow characteristics (e.g. a relatively low Reynolds number)

Figure 11:
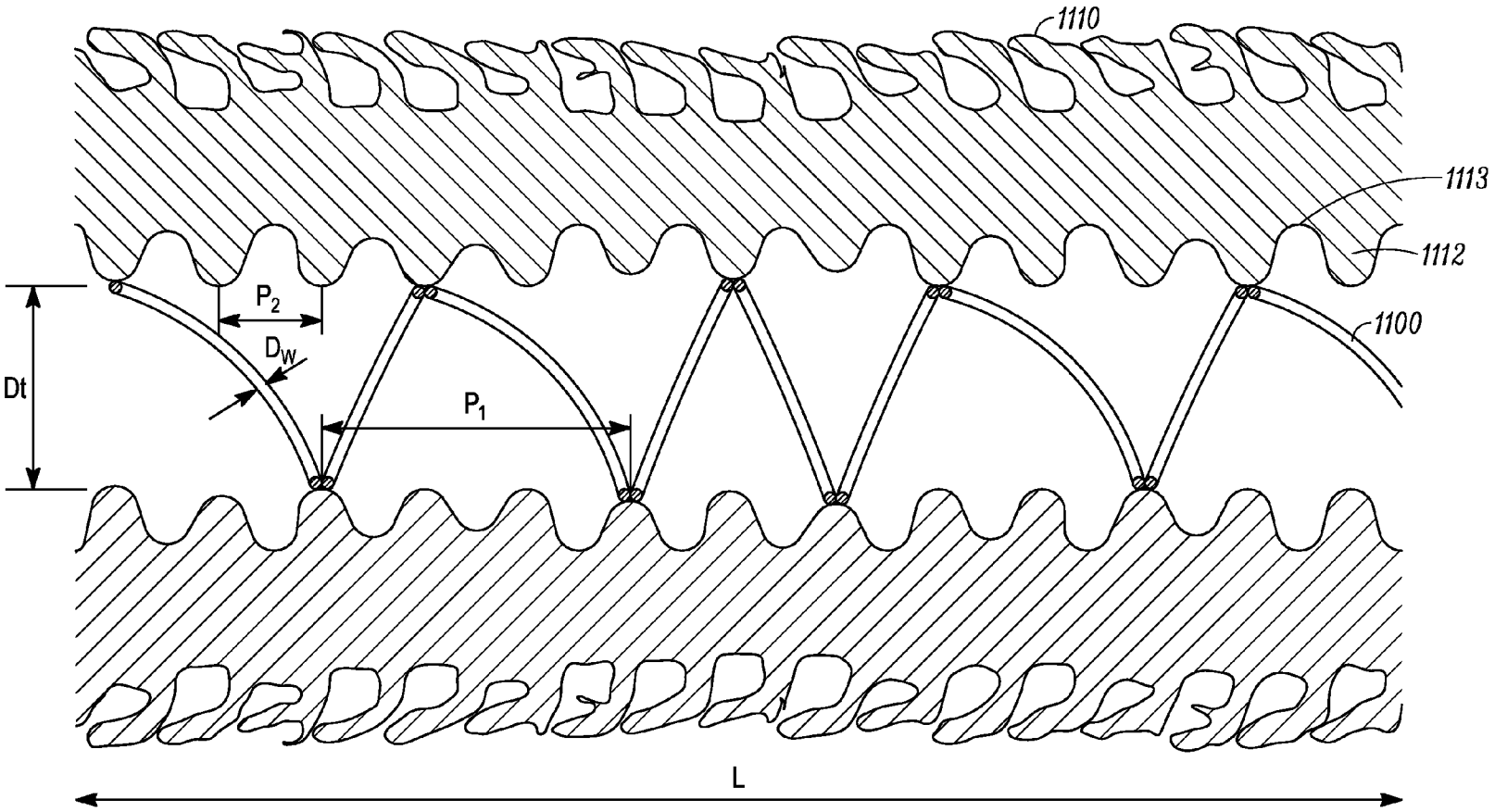
FIG. 11 is an enhance tube equipped with a turbulator.

FIG. 11 illustrates a turbulator 1000. The turbulator 1000, in the illustrated embodiment, includes a spiral wire structure. It is to be appreciated that a turbulator generally refers to a device that is configured to turn a laminar flow into a turbulent flow, and can have various configurations. The turbulator 1000 with the spiral wire structure can have a rounded/smooth profile, which may help reduce a pressure drop while creating turbulence in a fluid flow.

Figure 12:
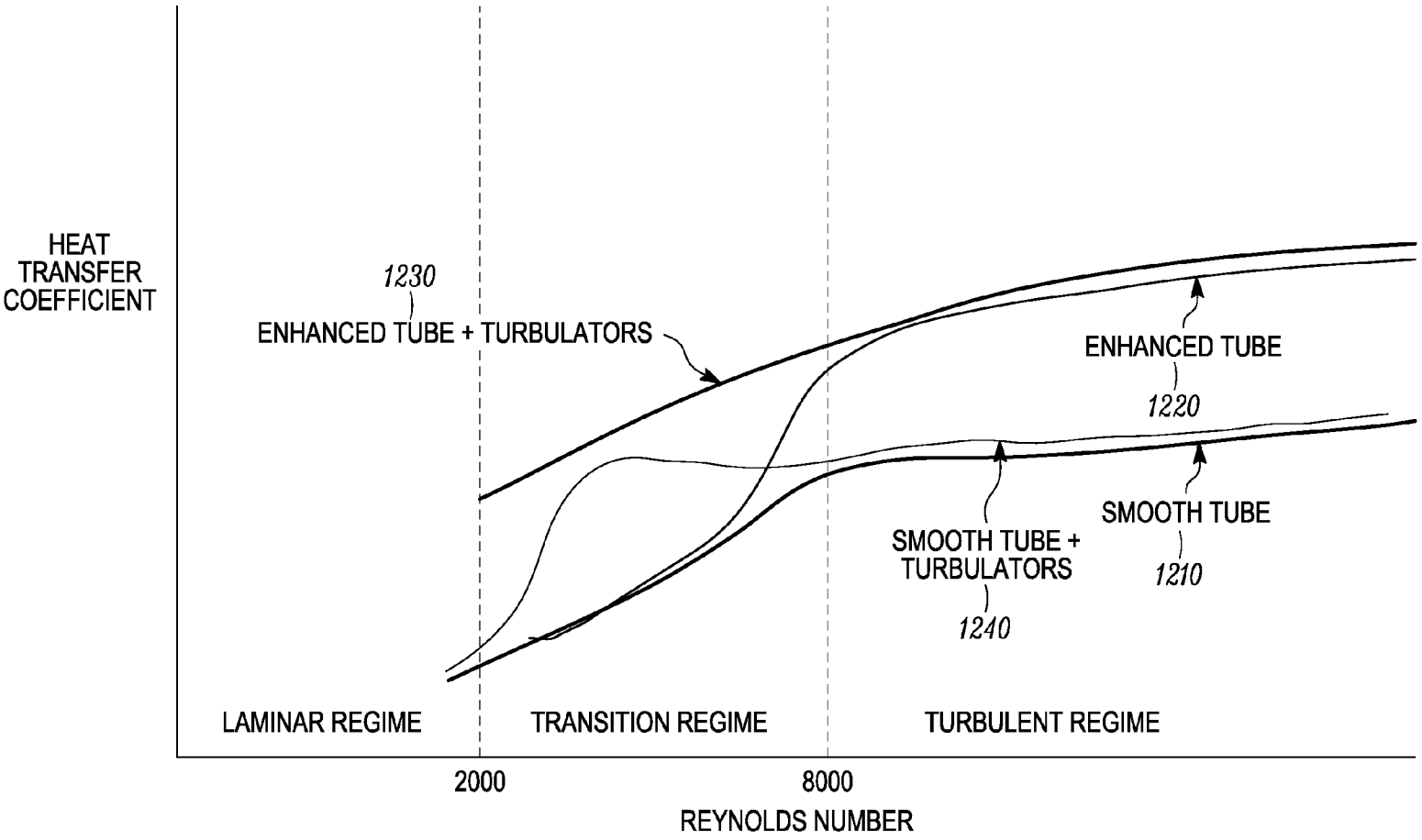
FIG. 12 illustrates a heat transfer coefficient/Reynolds number correlations for a smooth tube, an enhanced tube, a smooth tube with turbulators and an enhanced tube with turbulators.

FIG. 12 illustrates an enhanced tube 1110 equipped with a turbulator 1100 in an inner surface 1113 of the enhanced tube 1110. The inner surface 1113 may have surface features 1112.

The turbulator 1100 extends in a longitudinal direction L of the enhanced tube 1110. At least some portion of the turbulator 1100 is in direct contact with the surface features 1112 of the inner surface 1113.

Using a turbulator in a heat exchange tube may increase a pressure drop when a working fluid flows through the heat exchange tube. The turbulator/enhanced tube combination design therefore may take into consideration the benefit of increasing heat exchange efficiency and the disadvantage of an increased pressure drop. The configuration (e.g. diameter, size, pitch) of the turbulator 1100 and geometry of the enhanced tube 1110 may be varied to achieve an optimized balance.

As illustrated in FIG. 11, when the turbulator 1100 includes a spiral structure having a rounded profile, a turbulator diameter $D_w$, a tube inner diameter $D_t$, a pitch P1 (a distance between two neighboring spirals in the longitudinal direction L) of the turbulator 1200, and a pitch P2 (a distance between two neighboring surface features 1112 in the longitudinal direction L) may be considered to achieve a desired performance goal. In some embodiments, a ratio(s) between these parameters may be considered. In some embodiments, such as in a chiller, a tube inner diameter $D_t$ is at or about 0.5 inch to at or about 1.25 inch. In some embodiments, the tube inner diameter $D_t$ is at or about 0.65 inch to at or about 0.90 inch. In some embodiments, a turbulator diameter $D_w$ is at or about 0.025 inch to at or about 0.075 inch. In some embodiments, the turbulator diameter $D_w$ is at or about 0.04 inch to at or about 0.05 inch. In some embodiments, a pitch P1 of the turbulator 1100 is at or about 0.5 inch to at or about 1.75 inch. In some embodiments, a pitch P1 of the turbulator 1100 is at or about 1.0 inch to at or about 1.25 inch.

In some embodiments, when ratios between the turbulator diameter $D_w$, the tube inner diameter $D_t$, and the pitch P1 of the turbulator 1100 are considered, a ratio of $D_w/D_t$ may be at or about 0.06. In some embodiments, the ratio of $D_w/D_t$ may be at or about 0.04 to at or about 0.1. In some embodiments, a ratio of P1/$D_t$ may be at or about 1.75. In some embodiments, the ratio of P1/$D_t$ may be at or about 1 to at or about 2.5. It will be appreciated that ratios of P2 to any of P1, $D_w$ and/or $D_t$ may also be considered. As shown for example in FIG. 11, P1 is greater than P2 in some cases. In some examples, P1 can be at or about three times greater than P2 or two times greater such as shown in FIG. 11.

FIG. 12 illustrates an exemplary comparison of a heat transfer coefficient/Reynolds number correlations for a smooth heat exchange tube (curve 1210), an enhanced tube (curve 1220), an enhanced tube with turbulators (curve 1230) and a smooth heat exchange tube with turbulators (curve 1240). In the illustrated embodiment, a working fluid is in a laminar regime when the Reynolds number is below 2,000, and is in turbulent regime when the Reynolds number is above 8,000. The working fluid is in a transition regime when the Reynolds number is between 200 and 8,000. It is to be appreciated that the Reynolds numbers in the illustrated example are exemplary. The Reynolds numbers for the transition between the laminar regime to the transition regime, and/or between the transition regime to the turbulent regime may be determined for specific configurations.

The enhanced tube and the smooth tube behave similarly, e.g. has a similar heat transfer coefficient, in the transition regime. That is, surface features on an inner surface of the enhanced tube do not significantly contribute to heat transfer coefficient when the working fluid flow is in the transition regime. The enhanced tube with turbulators improves the heat transfer coefficient in the turbulent regime. That is, the surface features on the inner surface of the enhanced tube can contribute significantly to heat transfer coefficient when the working fluid flow is in the turbulent regime. The surface features on the inner surface can function as a turbulence generator to significantly generate turbulence in the working fluid flow when the working fluid flow is in the turbulent regime.

The smooth tube with turbulators has higher heat transfer coefficient in the transition regime, while the performance of the smooth tube with turbulators behave similarly to the smooth tubes in the turbulent regime. That is the turbulator can contribute significantly to heat transfer coefficient when the working fluid flow is in the transition regime. The turbulator can function as a turbulence generator to significantly generate turbulence when the working fluid flow is in the transition regime.

The heat transfer coefficient of the enhanced tube with turbulators is similar to the enhanced tube in the turbulent regime. FIG. 12 illustrates that the enhanced tube with turbulators can help improve the heat exchange coefficient in the transition regime without sacrificing the heat transfer coefficient in the turbulent regime.

In the illustrated embodiment, the heat transfer coefficient of the enhanced tube with turbulator (curve 1230) has better heat transfer coefficient in an intermediate regime within a portion of the transition regime and a portion of the turbulent regime than both the smooth tube with turbulator (curve 1240) and the enhanced tube (curve 1220). In the illustrated embodiments, with respect to Reynolds number, the intermediate regime may include Reynolds numbers lower than the transition point (e.g. 8,000 in FIG. 12) and Reynold numbers higher than the transition point between the transition regime and the turbulent regime. See where heat transfer coefficient is significantly improved before and just after the transition point, and also through the transition point, i.e. where curve 1230 is higher relative to curves 1220 and 1240. As shown, the heat transfer coefficient is also improved in a relatively smaller portion of the turbulent regime just beyond the transition point. When the working fluid flow is in the intermediate regime in the illustrated embodiment, the turbulator and the surface features of the enhanced tubes may contribute synergistically as a turbulence generator.

Figure 13:
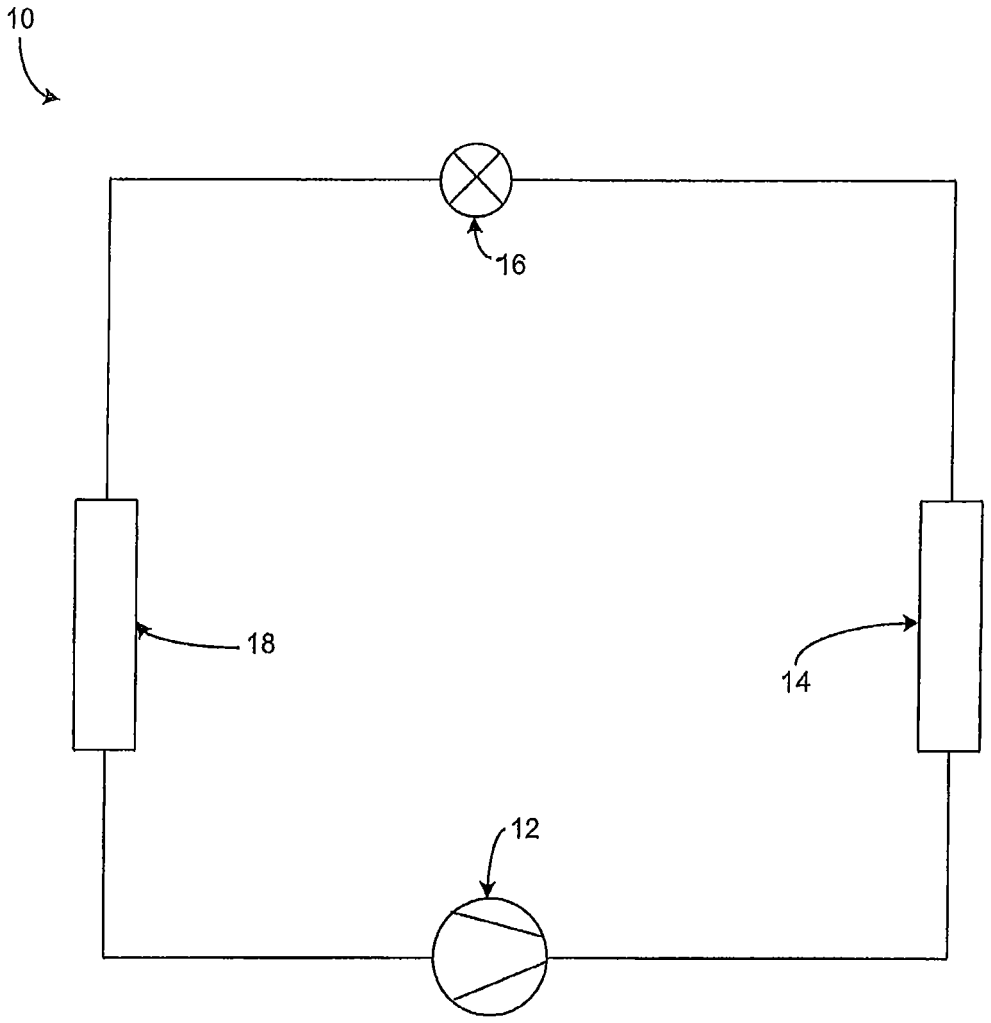
FIG. 13 is a schematic diagram of a heat transfer circuit 10, according to an embodiment.

The enhanced tube with turbulators may be used in a heat exchanger, which may be employed in a fluid chiller such as in an HVAC system (see e.g. FIG. 13). In some embodiments, the heat exchanger may be a shell-and-tube heat exchanger. In some embodiments, the heat exchanger may be a single pass heat exchanger. It is to be appreciated that the enhanced tube with turbulators may be used in other types of heat exchanger, such as for example a fin-and-tube heat exchanger (e.g. as a coil) or in other suitable types of heat exchangers that may use the tube designs herein.

FIG. 13 is a schematic diagram of a heat transfer circuit 10, e.g. which may be fluid chiller, according to an embodiment. The heat transfer circuit 10 generally includes a compressor 12, a condenser 14, an expansion device 16, and an evaporator 18. The heat exchange tubes herein may be incorporated in a heat exchanger, e.g. the evaporator 18 and/or condenser 14, of the heat transfer circuit 10. The compressor 12 can be, for example, a screw compressor. The heat transfer circuit 10 is exemplary and can be modified to include additional components. For example, in some embodiments the heat transfer circuit 10 can include other components such as, but not limited to, an economizer heat exchanger, one or more flow control devices, a receiver tank, a dryer, a suction-liquid heat exchanger, or the like. The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

The components of the heat transfer circuit 10 are fluidly connected. The heat transfer circuit 10 can be specifically configured to be a cooling system, e.g. a water chiller, capable of operating in a cooling mode.

Heat transfer circuit 10 operates according to generally known principles. The heat transfer circuit 10 can be configured to heat or cool a heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 12 compresses a heat transfer fluid (e.g., refrigerant or the like) from a relatively lower pressure gas to a relatively higher-pressure gas. The relatively higher-pressure and higher temperature gas is discharged from the compressor 12 and flows through the condenser 14. In accordance with generally known principles, the heat transfer fluid flows through the condenser 10 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer medium (e.g., water, air, etc.), heating the heat transfer fluid, and converting it to a gaseous form. The gaseous heat transfer fluid then returns to the compressor 12. The above-described process continues while the heat transfer circuit is operating, for example, in a cooling mode (e.g., while the compressor 12 is enabled).

Aspects

It will be appreciated that any of the aspects below may be combined with any other of the aspects below.

Aspect. A heat exchange tube includes: inner surface features; and a turbulator extends in a longitudinal direction inside the heat exchange tube.

Aspect. In some embodiments, at least a portion of the turbulator is positioned on the inner surface features.

Aspect. In some embodiments, the heat exchange tube also includes outer surface features, e.g. any of the enhanced tubes described herein.

Aspect. In some embodiments, the inner surface features contribute significantly to heat transfer coefficient when a working fluid flow is in a turbulent regime.

Aspect. In some embodiments, the turbulator contributes significantly to heat transfer coefficient when a working fluid flow in a transition regime.

Aspect. In some embodiments, the turbulator and the inner surface features contribute significantly to heat transfer coefficient when a working fluid flow is in an intermediate regime an intermediate regime including Reynolds numbers lower than a transition Reynolds number between a transition regime and a turbulent regime, and Reynolds numbers higher than the transition Reynolds number.

Aspect. In some embodiments, the turbulator can be made of metal, such as for example copper. In some embodiments, the turbulator can be made of a non-metal material. In some embodiments, the material of the turbulator may be non-corrosive and compatible with the material (e.g. copper) of the heat exchange tubes, compatible with the working fluid (e.g. water and/or glycol) and/or non-dissolvable in the working fluid.

Aspect. A method of fluid flow through a heat exchanger includes: directing a working fluid through the heat exchange tubes with the inner surface features and the turbulator.

Aspect. In some embodiments, directing the working fluid includes directing through a single pass of a heat exchanger, such as a shell and tube heat exchanger.

Aspect. A method of making a heat exchange tube, includes: providing inner surface features configured to significantly generate turbulence in a turbulence fluid flow regime on an inner surface of the heat exchange tube; providing a turbulator where the turbulator is configured to significantly generate turbulence in a transition fluid flow regime; and installing the turbulator in the heat exchange tube.

Aspect. In some embodiments, the inner surface features and the turbulator are configured to contribute synergistically in an intermediate regime including Reynolds numbers lower than a transition Reynolds number between a transition regime and a turbulent regime, and Reynolds numbers higher than the transition Reynolds number.

Aspect. In some embodiments, the method of making the heat exchange tube may include: fixing a first end of the turbulator on a first end of the heat exchange tube; and extending a second end of the turbulator to a second end of the heat exchange tube.

Aspect. In some embodiments, the turbulator may have a diameter that is larger than an inner diameter of the heat exchange tube. When the turbulator is extended in the heat exchange tube, a retraction tendency of the turbulator pushes the turbulator against the inner surface of the heat exchange tube to retain the turbulator within the heat exchange tube.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A heat exchange tube comprising:

inner surface features on an inner surface of the heat exchange tube including a rib structure that is rifled and includes two or more helices that cross over each other; and a turbulator that extends in a longitudinal direction inside the heat exchange tube, at least a portion of the turbulator is positioned on the inner surface features, the inner surface features and the turbulator have a relative structure and arrangement to synergistically improve a heat transfer coefficient relative to a heat exchange tube without both the inner surface features and the turbulator, and in an operation condition where the working fluid flow is in an intermediate regime, and the intermediate regime is defined as including Reynolds numbers including lower than a transition point before a turbulent flow regime, including the transition point, and including a relatively smaller portion of the turbulent flow regime, wherein a ratio of turbulator pitch P1 to a tube inner diameter $D_t$, P1/$D_t$, is from 1 to 2.5, and a ratio of a turbulator diameter $D_w$ to the tube inner diameter $D_t$, $D_w/D_t$, is from 0.04 to 0.1.

2. The heat exchange tube of claim 1, wherein the operation condition includes temperature applications at or below 32° F., and the transition point is a Reynolds number of 8000.

3. The heat exchange tube of claim 1, further comprising a ratio of turbulator pitch P1 to a pitch P2, the pitch P2 being a distance between two neighboring surface features in a longitudinal direction of the heat exchange tube, where the ratio P1/P2 is about 2 or 3.

4. The heat exchange tube of claim 1, further comprising outer surface features on an outer surface of the heat exchange tube.

5. The heat exchange tube of claim 1, wherein the turbulator is made of metal, is non-corrosive, is compatible with a material of the heat exchange tube, and is non-dissolvable with the working fluid.

6. The heat exchange tube of claim 1, wherein the turbulator is made of copper.

7. A fluid chiller comprising:

a heat exchanger including a shell with an internal volume; and multiple heat exchange tubes disposed within the internal volume of the shell, one or more of the multiple heat exchange tubes comprise inner surface features on an inner surface of the heat exchange tube including a rib structure that is rifled and includes two or more helices that cross over each other; and a turbulator that extends in a longitudinal direction inside the heat exchange tube, at least a portion of the turbulator is positioned on the inner surface features, the inner surface features and the turbulator have a relative structure and arrangement to synergistically improve a heat transfer coefficient relative to a heat exchange tube without both the inner surface features and the turbulator, and in an operation condition where the working fluid flow is in an intermediate regime, and the intermediate regime is defined as including Reynolds numbers including lower than a transition point before a turbulent flow regime, including the transition point, and including a relatively smaller portion of the turbulent flow regime, wherein a ratio of turbulator pitch P1 to a tube inner diameter $D_t$, P1/$D_t$, is from 1 to 2.5, and a ratio of a turbulator diameter $D_w$ to the tube inner diameter $D_t$, $D_w/D_t$, is from 0.04 to 0.1.

8. The fluid chiller of claim 7, wherein the heat exchanger is structured and arranged as a single pass shell and tube heat exchanger.

9. A method of making a heat exchange tube comprising:

providing inner surface features on an inner surface of the heat exchange tube including a rib structure that is rifled and includes two or more helices that cross over each other; and providing a turbulator that extends in a longitudinal direction inside the heat exchange tube, positioning at least a portion of the turbulator on the inner surface features; and arranging the inner surface features and the turbulator to synergistically improve a heat transfer coefficient relative to a heat exchange tube without both the inner surface features and the turbulator, and in an operation condition where the working fluid flow is in an intermediate regime, the intermediate regime is defined as including Reynolds numbers including lower than a transition point before a turbulent flow regime, including the transition point, and including a relatively smaller portion of the turbulent flow regime, wherein a ratio of turbulator pitch P1 to a tube inner diameter $D_t$, P1/$D_t$, is from 1 to 2.5, and a ratio of a turbulator diameter $D_w$ to the tube inner diameter $D_t$, $D_w/D_t$, is from 0.04 to 0.1.

10. The method of claim 9, wherein the operation condition includes temperature applications at or below 32° F., and the transition point is a Reynolds number of 8000.

11. The method of claim 9, further comprising providing a ratio of turbulator pitch P1 to a pitch P2, the pitch P2 being a distance between two neighboring surface features in a longitudinal direction of the heat exchange tube, where the ratio P1/P2 is about 2 or 3.

12. The method of claim 9, further comprising providing outer surface features on an outer surface of the heat exchange tube.

13. The method of claim 9, wherein the turbulator is copper.

14. The method of claim 9, further comprising fixing a first end of the turbulator on a first end of the heat exchange tube; and extending a second end of the turbulator to a second end of the heat exchange tube.

15. The method of claim 9, wherein the turbulator includes a diameter larger than an inner diameter of the heat exchange tube, such that extending the turbulator within the heat exchange tube and then releasing the heat exchange tube, a retraction tendency of the turbulator pushes the turbulator against the inner surface of the heat exchange tube to retain the turbulator within the heat exchange tube.

* * * * *